United States Patent [19]

Vecellio

[11] Patent Number: 4,491,684

[45] Date of Patent: Jan. 1, 1985

[54] FLAMEPROOF ELECTRIC CABLE IMPREGNATED WITH INSULATING FLUID

[75] Inventor: Bernardino Vecellio, Milan, Italy

[73] Assignee: Societa Cavi Pirelli S.p.A., Milan, Italy

[21] Appl. No.: 489,956

[22] Filed: Apr. 29, 1983

[30] Foreign Application Priority Data

Apr. 30, 1982 [IT] Italy ..... 21012 A/82

[51] Int. Cl.[3] ..... H01B 3/46; H01B 9/06

[52] U.S. Cl. ..... 174/26 R; 252/570; 252/573; 336/94; 174/25 C

[58] Field of Search ..... 252/570, 573; 336/94; 174/25 R, 25 C, 26 R

[56] References Cited

U.S. PATENT DOCUMENTS 3,108,153 10/1963 Feick et al. ..... 252/573

4,146,491 3/1979 Vincent ..... 252/573

*Primary Examiner*—Paul Lieberman

*Assistant Examiner*—Robert A. Wax

*Attorney, Agent, or Firm*—Brooks, Haidt, Haffner & Delahunty

[57] ABSTRACT

A flameproof electrical insulating fluid and an electrical cable impregnated with such fluid, the insulating fluid being a mixture of a polymethylsiloxane having a viscosity greater than 5 centistokes at 25° C. and an aromatic compound corresponding to the chemical formula:

where R is an aliphatic radical and said aromatic compound is present in the mixture in an amount from 0.5% to 10% by weight of the total weight of the mixture. Preferably, the aromatic compound is isopropyldiphenyl.

8 Claims, 2 Drawing Figures

FLAMEPROOF ELECTRIC CABLE IMPREGNATED WITH INSULATING FLUID

Figure 1:
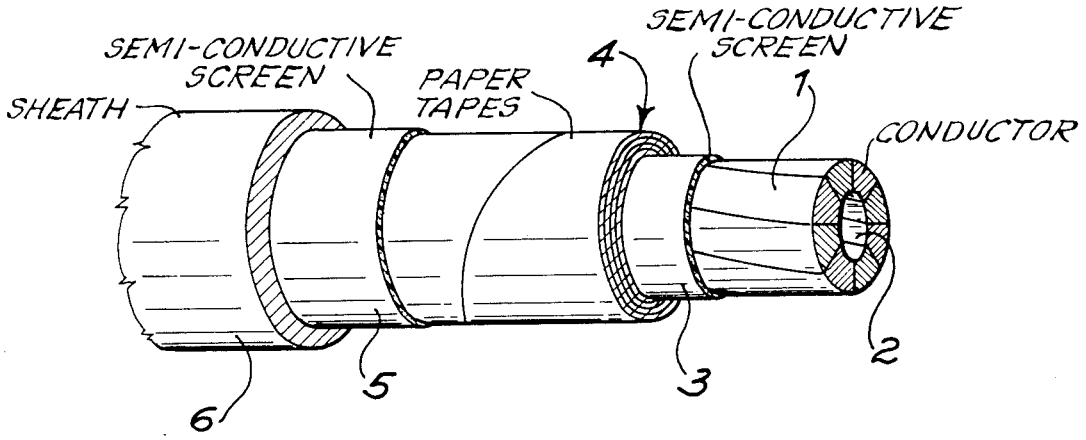

The present invention relates to a flameproof electric cable impregnated with an insulating fluid and, particularly, to an electric cable impregnated with an insulating fluid of the type usually known as an "oil-filled" electric cable and to an electric cable impregnated with an insulating fluid and used in systems of the type known as "pipe" systems and used for either direct or alternating current power transmission.

The present invention also relates to an insulating fluid for impregnating electric cables and the like.

When electric cables are impregnated with an insulating fluid, the fluid should have all the following properties:

- a high dielectric strength so as to provide a very good stratified insulation formed by impregnated layers wrapped around the electrical conductor;
- a low dielectric dissipation factor, or tan δ so as to provide a good efficiency in the power transmission;
- the viscosity of the insulating fluid, at any temperature at which the cable will be operating must be such as to allow an easy flow of the fluid along the cable;
- the physical condition of the insulating fluid must be constant, i.e. the insulating fluid must remain liquid at any temperature to which the cable can be subjected;
- a very good absorption of gas by part of the insulating fluid to avoid the formation of possible gas bubbles or, if any gas bubble should exist, prevention of an increase of its size, thereby to prevent the risk of perforations of the stratified solid insulation of the cable;
- flameproof characteristics of such a nature that, in the event of high temperatures or fire, no toxic gases are originated; and
- a low cost.

The difficulty of finding a chemical composition in which all the characteristics set forth are present at a high level, so that said composition may be used with good results as an impregnating and insulating fluid in electric cables, is clearly evident. Therefore, resort usually must be had to a compromise, giving up the presence, in the insulating fluid, of some features, such as, for example, flameproofing.

For this reason, only a few substances are known and used at the present time, or are recommended for use as impregnating and insulating fluids in electric cables.

Among the few substances proposed as impregnating and insulating fluids for electric cables, mention can be made of polydimethylsiloxanes.

Said polydimethylsiloxanes, which represent the most largely known type of the oils called "silicones", are interesting with respect to their flameproof properties, their possibility of remaining liquid at very low temperatures, their viscosity which is practically constant in a sufficiently wide range of temperatures, their comparatively low cost and their good values of dielectric dissipation factor or tan δ.

However, the drawback of polydimethylsiloxanes is that they have a relatively low dielectric resistivity and, above all, a poor ability to absorb gases in an electric field and, particularly, those gases which are generated in the course of time in consequence of the degradation occurring in the solid insulating material applied in layers around the conductor, such gases normally comprising hydrogen, carbon monoxide, carbon dioxide and water vapors.

To overcome such drawbacks of polydimethylsiloxanes, it has already been proposed to add to them certain compositions which improve their unsatisfactory properties.

By the addition of known additives to polydimethylsiloxanes, namely, the known mixtures based on polydimethylsiloxanes, the problem of gas absorption in the electric field has been solved. However, the presence of said known additives has given rise to further disadvantages, as for instance instability of the chemical composition of the mixture at low temperature and/or a degradation of the values of the dielectric dissipation factor or tan δ, so that, actually, the already known polydimethylsiloxane-containing mixtures do not appear to have had any practical application.

The objects of the present invention are to improve the characteristics of the electric cables impregnated with polydimethylsiloxane-containing insulating fluids as well as to improve the polydimethylsiloxane-containing insulating fluids in order to enable the latter to be used with good results and at a low cost for impregnating electric cables and the like.

Accordingly, one object of the present invention is a flameproof electric cable impregnated with insulating fluid, said cable comprising at least one conductor, a stratified, solid insulation applied in layers wrapped around said conductor and impregnated with an insulating fluid, and a containing envelope filled with insulating fluid, characterized in that said insulating fluid comprises a mixture of polydimethylsiloxane having a viscosity greater than 5 centistokes at 25° C. and an aromatic compound corresponding to the chemical formula:

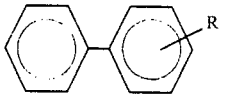

where R is an aliphatic radical, and where the aromatic compound is present in the mixture in an amount sufficient to provide the desired results but not greater than 10% by weight with respect to the total weight of the mixture.

Preferably, the aromatic compound forming part of the mixture, which is the insulating fluid of a cable according to the present invention, is isopropyldiphenyl corresponding to the chemcial formula:

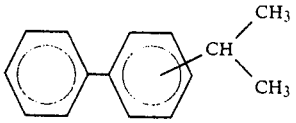

A further object of the invention is an insulating fluid for impregnating electric cables and the like characterized in that it comprises a mixture of a polydimethylsiloxane having a viscosity greater than 5 centistokes at 25° C. and an aromatic compound corresponding to the chemical formula:

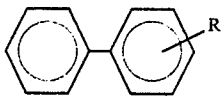

where R is an aliphatic radical, and where the aromatic compound is present in the mixture in an amount sufficient to provide the desired results but not greater than 10% by weight with respect to the total weight of the mixture.

Preferably the aromatic compound forming part of the mixture, which is the insulating fluid according to the present invention, is isopropyldiphenyl corresponding to the chemical formula:

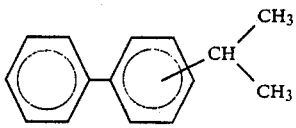

Figure 2:
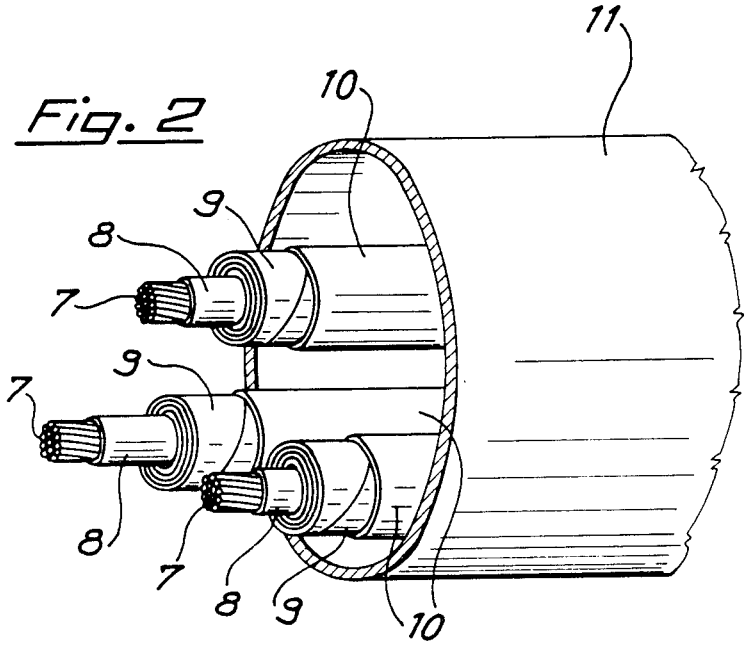

Other objects and advantages of the present invention will be apparent from the following detailed description of the presently preferred embodiments thereof, which description should be considered in conjunction with the accompanying drawings in which:

FIG. 1 is a perspective view, with parts broken away to show the cable structure, of an electric cable impregnated with an insulating fluid and of the type commonly known as an "oil-filled" cable; and FIG. 2 is a perspective view, with parts broken away to show the cable structure, of an electric cable impregnated with an insulating fluid for cable systems commonly known as "pipe" systems.

The electric cable shown in FIG. 1 comprises a conductor 1 which has a coaxially extending duct 2 which is filled with insulating fluid and which is provided to allow the fluid to flow along the cable.

Around the electric conductor 1, there is at first a semi-conductive screen 3 surrounded by a solid, stratified, or multi-layered, insulation 4 applied in layers and formed by a plurality of windings of insulating tapes which are made entirely of cellulosic material.

The solid, stratified insulation 4, applied in layers, is impregnated with an insulating fluid and, over it, there is a semi-conductive screen 5. The assembly formed by such elements is enclosed by a sheath 6, made, for instance, of metallic material, such as lead or aluminum. The sheath 6 may be smooth or corrugated.

FIG. 2 represents an electric cable impregnated with insulating fluid and included in a "pipe" cable system. The electric cable shown in FIG. 2 comprises a group of three conductors 7 around each of which is applied a semi-conductive screen 8 which is covered by a solid, stratified insulation 9 applied in layers and formed by a plurality of windings of insulating tapes, the tapes being made entirely of cellulosic material.

The solid, stratified insulation 9, applied in layers around each conductor 7, is impregnated with an insulating fluid and, around it, there is a semi-conductive screen 10.

The group of three conductors 7, each provided with the described elements, is enclosed within a rigid pipe 11 which is also filled with the insulating fluid.

In the present specification both the sheath 6 of a cable of the type represented in FIG. 1 and the rigid pipe 11 of a cable shown in FIG. 2 will be included in the expression "containing envelope".

The most general solution, according to the present invention, is that of using, as the insulating fluid for a cable, a mixture formed by a polydimethylsiloxane represented by the chemical formula:

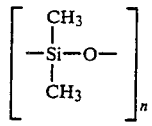

and an aromatic compound represented by the chemical formula:

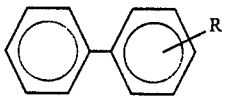

where R is an aliphatic radical and where, preferably, R is an aliphatic radical represented by the chemical formula:

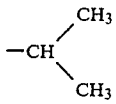

More particularly, the solution, according to the present invention, is that of providing a mixture containing a polydimethylsiloxane having a viscosity greater than 5 centistokes at 25° C. and an aromatic compound, corresponding to the chemical formula:

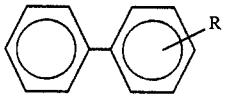

where R is an aliphatic radical and preferably, R is:

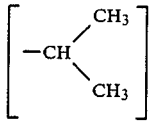

in which the aromatic compound is present in an amount from 0.5% to less than 10% by weight of the total weight of the mixture and preferably, the aromatic compound is present in an amount ranging between 3% and 7% by weight of the total weight of the mixture.

In particular, when R is the above-stated radical the aromatic compound is isopropyldiphenyl, and in this case, it can be paramonoisopropyldiphenyl or metamonoisopropyldiphenyl or a mixture of these isomers.

Monoisopropyldiphenyl has a good resistance to aging in the presence of metals such as the copper forming the cable conductor. Therefore, a considerable stability, over the course of time, can be achieved with an insulating fluid composed of mixtures of polydimethylsiloxane and isopropyldiphenyl.

A plurality of experimental tests are carried out on an insulating fluid in accordance with the invention, namely, a fluid formed by a mixture of polydimethylsiloxane and isopropyldiphenyl, in order to establish by data that, by using said mixture, it is possible to achieve the stated objects of the invention. Analogous experimental comparison tests were effected with polydimethylsiloxane only.

A first series of experimental tests was carried out to provide data on the flameproof characteristics of an insulating fluid of the present invention, and analogous comparison tests were carried out on polydimethylsiloxanes, on monoisopropyldiphenyl, and on a hydrocarbon insulating fluid commonly used as impregating medium for electric cables, such as decylbenzene.

To evaluate the flameproof properties of the fluids under consideration, experimental tests were carried out to determine the "Flash Point" and "Fire Point" in accordance with the procedures as set forth in the ASTM D-93-79 STANDARDS.

The expression "Flash Point" means the temperature of a fluid at which a small flame placed on the fluid surface gives rise to a "flash" which extinguishes spontaneously.

The expression "Fire Point" means the temperature of a fluid at which the combustion of the vapors emitted by the fluid under the action of a small flame applied to its surface lasts at least five minutes.

The experimental tests of the first series were effected using polydimethylsiloxanes sold by Dow Corning Corporation, such polydimethylsiloxanes being identified by the trade symbols DC 200/5, DC 200/10, DC 200/20, DC 200/50, and using polydimethylsiloxanes sold by Rhone Poulenc, the latter polydimethylsiloxanes being identified by the trade symbols 47V/10, 47V/20 and 47V/50. The numbers following the slash marks indicate the viscosity of the polydimethylsiloxane in centistokes at 25° C.

The first series of experimental tests were carried out on insulating fluids according to the present invention and constituted by mixtures of polydimethylsiloxane and isopropyldiphenyl in various percentages of the latter. In particular, the mixtures were obtained by adding to the above indicated polydimethylsiloxanes of Dow Corning Corporation and Rhone Poulenc different amounts of the isopropyldiphenyl sold by Sun Petroleum Products Company under the trade name Suresol 250, in the percentages reported in the following table, which shows the results of the first series of experimental tests:

TABLE I

| Insulating fluid | "Flash Point" °C. | "Fire Point" °C. |
|---|---|---|
| DC 220/5 | 148 | 162 |
| DC 200/10 | 182 | 222 |
| DC 220/20 | 235 | 310 |
| DC 200/50 | 280 | greater than 350 |
| 47 V/10 | 162 | 205 |
| 47 V/20 | 224 | 300 |
| 47 V/50 | 280 | greater than 350 |
| DC 200/20 plus 3% of Suresol 250 | 190 | 286 |
| DC 200/20 plus 5% of Suresol 250 | 180 | 248 |
| DC 200/20 plus 7% of Suresol 250 | 175 | 235 |
| 47 V/20 plus 3% of Suresol 250 | 178 | 278 |
| 47 V/20 plus 5% of Suresol 250 | 168 | 255 |
| Suresol 250 | 144 | 164 |

TABLE I-continued

| Insulating fluid | "Flash Point" °C. | "Fire Point" °C. |
|---|---|---|
| Decylbenzene | 120 | 126 |

From the examination of the results appearing in TABLE I, it can be noted, first of all, that, to provide flameproof insulating fluids for impregnating electric cables according to the invention, the polydimethylsiloxanes like DC 200/5, namely, those having a viscosity of 5 centistokes, are to be eliminated from consideration, since they, with respect to flameproofing, have properties comparable with those of hydrocarbon fluids, such as decylbenzene, which are considered inflammable.

With the exception of the above, it can be noted that an insulating fluid for impregnating electric cables, according to the invention and formed by a mixture of polydimethylsiloxane and isopropyldiphenyl, maintains the very good flameproof characteristics as is demonstrated by high temperature values both as regards "flash point" and "fire point" in spite of the fact that isopropyldiphenyl is an inflammable substance. Thus, all of the insulating fluids of the invention have high "flash" and "fire" temperatures, and in some cases, the "flash" and "fire" temperatures are better than the "flash" and "fire" temperatures of polydimethylsiloxane alone.

A second series of experimental tests was effected to provide data for the physical characteristics of the insulating fluids according to the invention and of polydimethylsiloxanes, i.e., their permanent liquid state.

More specifically, this second series of tests comprises tests carried out to evaluate the viscosity of the fluids at room temperature, their points of state modification being observed through the features known to those skilled in this art as "Pour Point", which is defined by ASTM D 97-66 STANDARDS, and through the initial temperature of separation of homogeneous compositions, which is determined by visual observation of the formation of a milky liquid.

Said second series of experimental tests was carried out on the same insulating fluids which had been tested in the first series, with the exception of those eliminated on account of their inflammability characteristics.

The results of the second series of experimental tests are reported in the following table:

TABLE II

| Insulating fluid | Viscosity at 25° C. in cst | Pour Point | Separation Initial temperature |
|---|---|---|---|
| DC 200/10 | 10 | lower than −50° C. | — |
| DC 200/20 | 20 | lower than −50° C. | — |
| DC 200/50 | 50 | lower than −50° C. | — |
| 47 V/10 | 10 | lower than −50° C. | — |
| 47 V/20 | 20 | lower than −50° C. | — |
| 47 V/50 | 50 | lower than −50° C. | — |
| DC 200/20 plus 3% of Suresol 250 | 19.5 | lower than −50° C. | lower than −50° C. |
| DC 200/20 plus 5% of Suresol 250 | 18.8 | lower than −50° C. | lower than −50° C. |
| DC 200/20 plus 7% of Suresol 250 | 18 | lower than −50° C. | −26° C. |
| 47 V/20 plus 3% of Suresol 250 | 19.8 | lower than −50° C. | lower than −50° C. |
| 47 V/20 plus 5% of Suresol 250 | 19.5 | lower than −50° C. | lower than −50° C. |

From the examination of the results of the experimental tests shown in TABLE II, the following can be noted:

the viscosity values of an insulating fluid for impregnating cables according to the invention are lower than those of the corresponding polydimethylsiloxane. This means that the insulating fluids according to the invention can more easily flow along the cable;

the values of the separation temperature can be obviously evaluated only for the mixtures and not for a pure substance as is polydimethylsiloxane. The separation temperatures of the insulating fluids of the invention, are extremely low, i.e., are by far different from the temperatures to which a cable could be subjected in use, provided that the amount of isopropyldiphenyl is not greater than 10% by weight of the total weight of the composition; and the temperature values at which an initial solidification can take place in an insulating fluid of the invention are, like the values for polydimethylsiloxane, lower than those needed for any possible cable requirement. This means that an insulating fluid for impregnating electric cables according to the invention has, as to these effects, the same desirable characteristics of polydimethylsiloxane, as can be seen from examining the values reported in column headed "Pour Point".

A third series of experimental tests was carried out to provide data for the dielectric characteristics of those fluids for impregnating cables according to the invention which are considered very good after the results of the two preceding series of tests.

More precisely, experimental tests were made to evaluate the dielectric dissipation factor, or tan δ, and the dielectric strength of flat specimens.

The determination of the dielectric dissipation factor, or tan δ, was carried out in accordance with the IEC247 (1978) STANDARDS.

The determination of the dielectric strength of flat specimens was carried out as explained hereinbelow.

Three sheets of cellulosic paper, used to form the layers of a cable insulation and having a thickness of 80 μm, were doubled together, leving in the central sheet a circular channel, 4 mm in diameter. The resulting unit was placed between two flat circular electrodes having a diameter of 3 cm and the paper sheets were dried. Then, the unit was impregnated with the previously degassed insulating fluid under examination, and the dielectric was subjected to a mechanical pressure of 0.2 kg/cm$^2$, exerted by the electrodes.

At this time, voltage was applied to the two electrodes and the value of the voltage causing the perforation of the dielectric was measured.

The above experimental tests were effected on the insulating fluids for the impregnation of electric cables according to the invention which were considered very good from the preceding tests, as well as on the polydimethylsiloxanes forming the basic component of the insulating fluids according to the invention itself.

The results of this third series of experimental tests are reported in the following table:

TABLE III

| Insulating fluid | tan "δ" at 100° C. | Alternating current dielectric strength in a.c. of cellulosic insulation impregnated with insulating fluid as indicated |
|---|---|---|
| DC 200/20 | 0.3% | 48 KV/mm |
| 47 V/20 | 0.5% | 48–50 KV/mm |
| DC 200/20 plus 3% of Suresol 250 | 0.2% | 50 KV/mm |
| DC 200/20 plus 5% of Suresol 250 | 0.1% | 53 KV/mm |
| 47 V/20 plus 3% of Suresol 250 | 0.3% | 58 KV/mm |
| 47 V/20 plus 5% of Suresol 250 | 0.3% | 57 KV/mm |

From the examination of the experimental results reported in TABLE III, it is clear that an electric cable insulation impregnated with an insulating fluid according to the invention has considerably improved dielectric characteristics compared to those of insulation impregnated with polydimethylsiloxane only.

A fourth series of experimental tests was carried out to determine the behavior of an electric cable according to the invention, and of an insulating fluid of impregnating electric cables according to the invention, in the presence of an electric field, in particular, an alternating current electric field, in order to estimate the degree of absorption of the gases which are generated in the cable in use.

Gases can be present in a cable for two reasons:

imperfect degassing of the insulating fluid of a cable during the cable manufacture; and formation of gas consequent to the degradation, due to aging, of the layers of solid material forming the cable insulation, particularly at high temperatures.

The gases present in the cable consist substantially of hydrogen, carbon monoxide, carbon dioxide and water vapors. Their presence is undesirable, since the presence thereof can result in the perforation of the cable insulation and in the putting out of service of the cable when the gases are not chemically absorbed by the insulating fluid impregnating the cable.

Among the gases which can be generated in a cable, hydrogen is the one capable of giving the best index for the determination of the degree of gas absorption by an insulating fluid.

Consequently, experimental tests were carried out in order to determine the degree of hydrogen absorption by the insulating fluids according to the invention and by the relative basic polydimethylsiloxanes, and the results are reported in the following TABLE IV. Said experimental tests, known as "gassing" tests, were carried out in accordance with IEC 628-1978 STANDARDS.

TABLE IV

| Insulating fluid | Average values of hydrogen absorption or generation at 140° C. in microliters/minute |
|---|---|
| DC 220/20 | 62 - generated |
| 47 V/20 | 40 - generated |
| DC 200/20 plus 3% of Suresol 250 | 13 - generated |
| DC 200/20 plus 5% of Suresol 250 | 41 - absorbed |
| DC 200/20 plus 7% of Suresol 250 | 60 - absorbed |
| 47 V/20 plus 3% of Suresol 250 | 125 - absorbed |
| 47 V/20 plus 5% of Suresol 250 | 100 - absorbed |

Analogous tests, for the other gases which can be generated in a cable, that is, carbon monoxide, carbon dioxide and water vapors, were made in respect of two insulating fluids according to the invention which are considered to be among the best. They are DC200/20 plus 5% by weight of Suresol 250 of the total weight of the composition and 47 V/20 plus 5% by weight of Suresol 250 of the total weight of the composition.

The results of these experimental tests are reported in the following TABLE V.

TABLE V

| Insulating fluid | Average values of absorption or generation at 140° C. in micro-liters/minute | | |
|---|---|---|---|
| | carbon monoxide | carbon dioxide(°) | water vapors |
| DC 200/20 plus 5% of Suresol 250 | 30 - absorbed | 8 - absorbed | 26 - absorbed |
| 47 V/20 plus 5% of Suresol 250 | 30 - absorbed | 8 - absorbed | 25 - absorbed |

(°) With respect to carbon dioxide, a non-linear generation/absorption phenomenon took place during the test. At first, there was generation of this gas but, after a time interval, it was absorbed by the insulating fluid. The absorption values are those reported in the table.

From an examination of the experimental tests appearing in TABLES IV and V, it is evident that the insulating fluids for impregnating electric cables according to the invention are able to absorb the gases which might be generated during the life of a cable, eliminating, therefore, any risk of perforating the insulation and consequently of putting the cable out of service.

The totality of the results obtained from all the series of experimental tests demonstrates that an electric cable impregnated with an insulating fluid according to the invention, as well as the insulating fluids according to the invention for impregnating both the cables of the "oil-filled" type and those of the "pipe" system, are able to comply with all the above indicated requirements which are the objects of the invention.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. A flameproof electric cable impregnated with an insulating fluid, which comprises at least one conductor, a stratified solid insulation applied in layers, of cellulosic material wrapped around the conductor and impregnated with said insulating fluid and a containing envelope around said solid insulation and filled with insulating fluid, said insulating fluid comprising a mixture of a polydimethylsiloxane having a viscosity greater than 5 cst at 25° C. and an aromatic compound corresponding to the chemical formula:

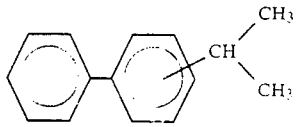

where said aromatic compound is present in the mixture in amount from 0.5% to 10% by weight with respect to the total weight of the polydimethylsiloxane and said aromatic compound.

2. A flameproof electric cable as set forth in claim 1, wherein said aromatic compound is present in an amount from 3% to 7% by weight of the total weight of the mixture.

3. A flameproof electric cable as set forth in claim 1, wherein said containing envelope is a sheath, wherein said conductor has a coaxial duct extending inside the conductor which is filled with said insulating fluid and wherein said stratified solid insulation comprises layers of cellulosic tape wrapped around said conductor.

4. A flameproof electric cable as set forth in claim 3, wherein said aromatic compound is present in an amount from 3% to 7% by weight of the total weight of the mixture.

5. A flameproof electric cable as set forth in claim 1, wherein there are at least three conductors with cellulosic material wrapped therearound and impregnated with said insulating fluid and wherein said containing envelope is a rigid metal pipe around said conductors.

6. A flameproof electric cable as set forth in claim 5, wherein said aromatic compound is present in an amount from 3% to 7% by weight of the total weight of the mixture.

7. An insulating fluid for impregnating electric cables and the like, said insulating fluid comprising a mixture of a polydimethylsiloxane having a viscosity greater than 5 cst at 25° C. and an aromatic compound corresponding to the chemical formula:

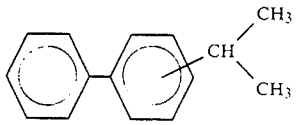

where said aromatic compound is present in the mixture in an amount from 0.5% to 10% by weight with respect to the total weight of the polydimethyl siloxane and said aromatic compound.

8. An insulating fluid for impregnating electric cables as set forth in claim 7, wherein said aromatic compound is present in the mixture in an amount from 3% to 7% by weight of the total weight of the mixture.

* * * * *